US007303086B2

(12) United States Patent
Nhan et al.

(10) Patent No.: US 7,303,086 B2
(45) Date of Patent: Dec. 4, 2007

(54) DISPOSABLE CONTAINERS FOR PREPARE, STORAGE AND SERVING INFANT FORMULA

(75) Inventors: Davis Dang Hoang Nhan, Appleton, WI (US); William Hung Nguyen, New Brighton, MN (US)

(73) Assignee: ZNN Technologies, LLC, Appleton, WI (US)

( * ) Notice: Subject to any disclaimer, the term of this patent is extended or adjusted under 35 U.S.C. 154(b) by 0 days.

(21) Appl. No.: 11/060,820

(22) Filed: Feb. 18, 2005

(65) Prior Publication Data

US 2005/0194342 A1 Sep. 8, 2005

Related U.S. Application Data

(60) Provisional application No. 60/545,137, filed on Feb. 18, 2004.

(51) Int. Cl.
*A61J 9/00* (2006.01)
*A47G 19/22* (2006.01)

(52) U.S. Cl. ..... 215/11.3; 215/11.1; 220/703; 220/711

(58) Field of Classification Search ..... 215/11.3, 215/11.6, 11.1; 220/62.12, 703, 711, 738; 229/403

See application file for complete search history.

(56) References Cited

U.S. PATENT DOCUMENTS

| | | | | | |
|---|---|---|---|---|---|
| 2,110,928 | A * | 3/1938 | De Buys | ..... | 215/11.6 |
| 2,987,209 | A * | 6/1961 | Royal | ..... | 215/11.3 |
| 3,851,781 | A * | 12/1974 | Marco | ..... | 215/11.3 |
| 4,435,344 | A * | 3/1984 | Iioka | ..... | 264/45.1 |
| 4,600,111 | A * | 7/1986 | Brown | ..... | 215/6 |
| 4,850,496 | A * | 7/1989 | Rudell et al. | ..... | 215/12.1 |
| 5,038,948 | A * | 8/1991 | Signorini | ..... | 215/11.1 |
| 5,542,922 | A * | 8/1996 | Petterson et al. | ..... | 604/77 |
| 5,806,711 | A * | 9/1998 | Morano et al. | ..... | 221/33 |
| 6,136,396 | A * | 10/2000 | Gilmer | ..... | 428/36.5 |
| 6,142,331 | A * | 11/2000 | Breining et al. | ..... | 220/62.12 |
| 6,616,000 | B1 * | 9/2003 | Renz | ..... | 215/11.1 |
| 6,651,845 | B1 * | 11/2003 | Schroeder | ..... | 222/83 |

* cited by examiner

*Primary Examiner*—Sue A. Weaver
(74) *Attorney, Agent, or Firm*—Brendan C. Babcock; Babcock Legal Services, PLLC

(57) ABSTRACT

The present invention provides infant and toddler feeding and liquid food storing systems. Disposable containers and infant feeding assemblies are provided for preparing, storing, and serving a liquid food or other beverage to children or other subjects having special needs. The assembly can comprise a holder, a disposable container that fits into the holder, and a means for delivering the food to the subject, e.g., using a nipple or drinking spout.

14 Claims, 22 Drawing Sheets

DISPOSABLE CONTAINERS FOR PREPARE, STORAGE AND SERVING INFANT FORMULA

This application claims the benefit of U.S. Provisional Application Ser. No. 60/545,137, filed Feb. 18, 2004, which is hereby incorporated by reference in its entirety.

FIELD OF THE INVENTION

The present invention relates to infant and toddler feeding and storing system. More particularly, the present invention relates to disposable containers and nursing assemblies that can be used for preparing, storing and serving liquid food or perishable beverages such as juice, breast milk and infant formula.

BACKGROUND OF THE INVENTION

Infants are required to be fed very frequently with a small amount of milk such as breast milk or infant formula, and therefore many clean bottles shall be needed. In order to minimize a chance that a baby can be infected by bacteria, the bottle shall be washed and sterilized with boiling water or steam before it is used. Such activities of washing and sterilizing bottles are extra work for parents who are already tired and do not have enough sleep. Therefore, it is advantage to have a bottle or container that is pre-sterilized before use and can be disposed after use. Preparing, storing, and serving liquid food or perishable beverages in a most convenient way that shall free the parents from washing and sterilizing baby bottles is the main focus of this invention.

A disposable baby feeding bottle for babies was described in U.S. Pat. No. 2,599,630 to Hair. In the Hair patent, a nursing assembly incorporating a disposable paper container is disclosed for feeding a baby during the traveling. The container is thrown away after each feeding. Thus, eliminating the need to wash and sterilize an used bottle. Nevertheless, this nursing assembly suffers a number of shortcomings. First, the nipple and the flange portion of the bottle are engaged together to form a seal by the interlocking of upper and lower brackets. When an excess force is applied by the brackets and the flange portion which may have already be softened by the infant formula contained therein, the flange portion of the bottle will be torn, ripped or distorted from a circular shape. When this disengagement or misalignment between the nipple and the flange portion occurred, a leakage will result. Second, when manipulating or holding the nursing assembly at the bottle with an excess force, the flange portion of the bottle can be torn or ripped. Thus, leakage will occur. Third, the nipple in the nursing assembly described in the Hair patent has a tailored design to form a seal with the flange portion of the bottle. This limits the use of the disposable bottle to only the described nursing assembly.

A nursing assembly for infant incorporating a disposable cup was described in U.S. Pat. No. 5,758,787 to Sheu. In the Sheu patent, a special collar socket with a skirt portion is required to secure a paper cup to the nursing assembly. The Sheu patent claimed improvements over the Hair patent described above. Nevertheless, in this design, it can be concluded with the following defects and which shall be solved sooner or later. First, the collar socket with a skirt portion is contact with an infant formula when it is used in the nursing assembly. Therefore, it is an extra part that needs to be washed and sterilized before it is used. It defeats a purpose of using a paper cup as container. Second, when manipulating, holding or accidentally step on the nursing assembly by the bottle with an excess force, the cup can be crumbled or ripped. Thus, leakage will occur.

A nursing assembly for infant incorporate a disposable plastic container was described in U.S. Pat. No. 3,851,781 to Marco. In the Marco patent, a plastic container which has thin and flexible body portion and thicker and less flexible rim portion is used as a disposable container for a nursing assembly. Similar disposable plastic containers can be found in the market manufactured by Playtex Products, Inc. of Dover, Del. The Playtex bottle consists of a cylindrical holder, in which a plastic liner bag is placed and filled with liquid food. In one variant, the plastic liner top is stretched over the top of the holder. In another variant, the plastic liner bag is provided with a semi-rigid rim around the top of to facilitate installation of the bag in just on hand. In either case, it requires parents to prepare infant formula in a separate container and let that cools down before transferring the formula to the plastic liner bag. Furthermore, these plastic liner bags should not be heated up in a microwave. Therefore, it is not convenient for parents.

Therefore, there is a need in the art for a disposable container suitable for preparing, short-term storing and feeding of liquid food such as infant formula directly from a single container to minimize the possibility of contamination of the contents and maximizing the usefulness and convenience of the container for parents. Further, there is a need in the art to make a container which can be disposable and affordable.

SUMMARY OF THE INVENTION

It is an objective of the present invention to provide an infant nursing assembly that reduces the number of parts necessary to be washed and sterilized after each use.

It is another object of the present invention to provide an infant nursing assembly that reduces the amount of clean ups due to use of multiple containers.

It is another object of the present invention to provide a disposable container for an infant nursing assembly that does not deform its shape when contacts with boiling water.

It is another object of the present invention to provide a disposable container for an infant nursing assembly that does not be soften by a liquid food after storing for several days.

It is another objective of the present invention to provide an infant/toddler drinking cup that is disposable after use.

The above objectives and advantages of the present invention are provided by an infant nursing assembly comprising a disposable container, a holder and a nipple bracket. The disposable container has an open end and generally made from polymer coated paper-board, plastics or combination thereof. The top of the container is provided with a circular flange about the circumference of the cup, such that the liquid filled cup can be dropped down into a cylindrical holder. The container can be use to prepare infant formula, store the formula inside the container for short-term, and feed the formula to an infant by mounting the formula filled container into the nursing assembly.

DETAILED DESCRIPTION OF THE INVENTION

Figure 1:
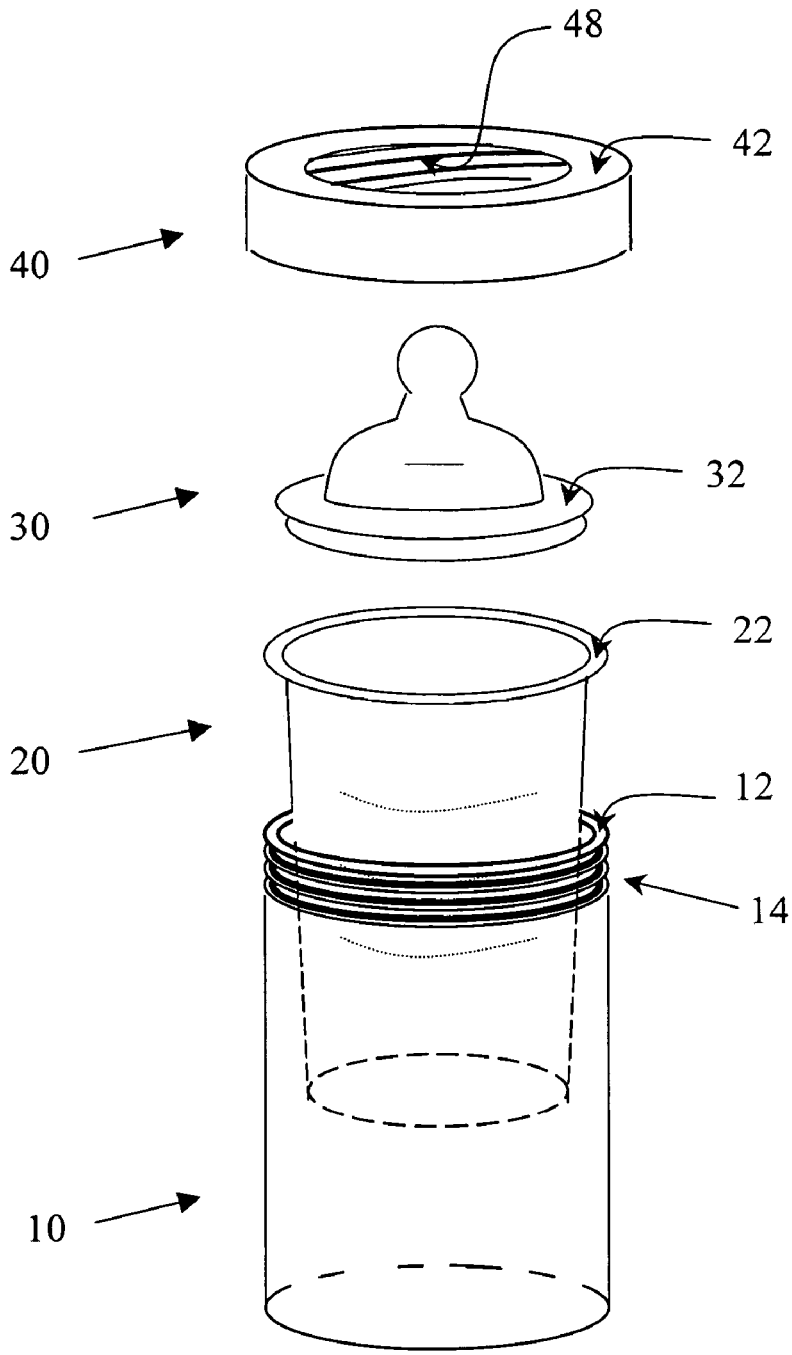
FIG. 1 representatively illustrates an exploded view of the components of the nursing assembly of the present invention.

The nursing assembly of the present invention shown in FIG. 1 generally has a holder 10 a disposable container 20, locking ring 40 and a nipple 30. For storage, the nursing assembly further has a disposable lid 100.

Figure 2:
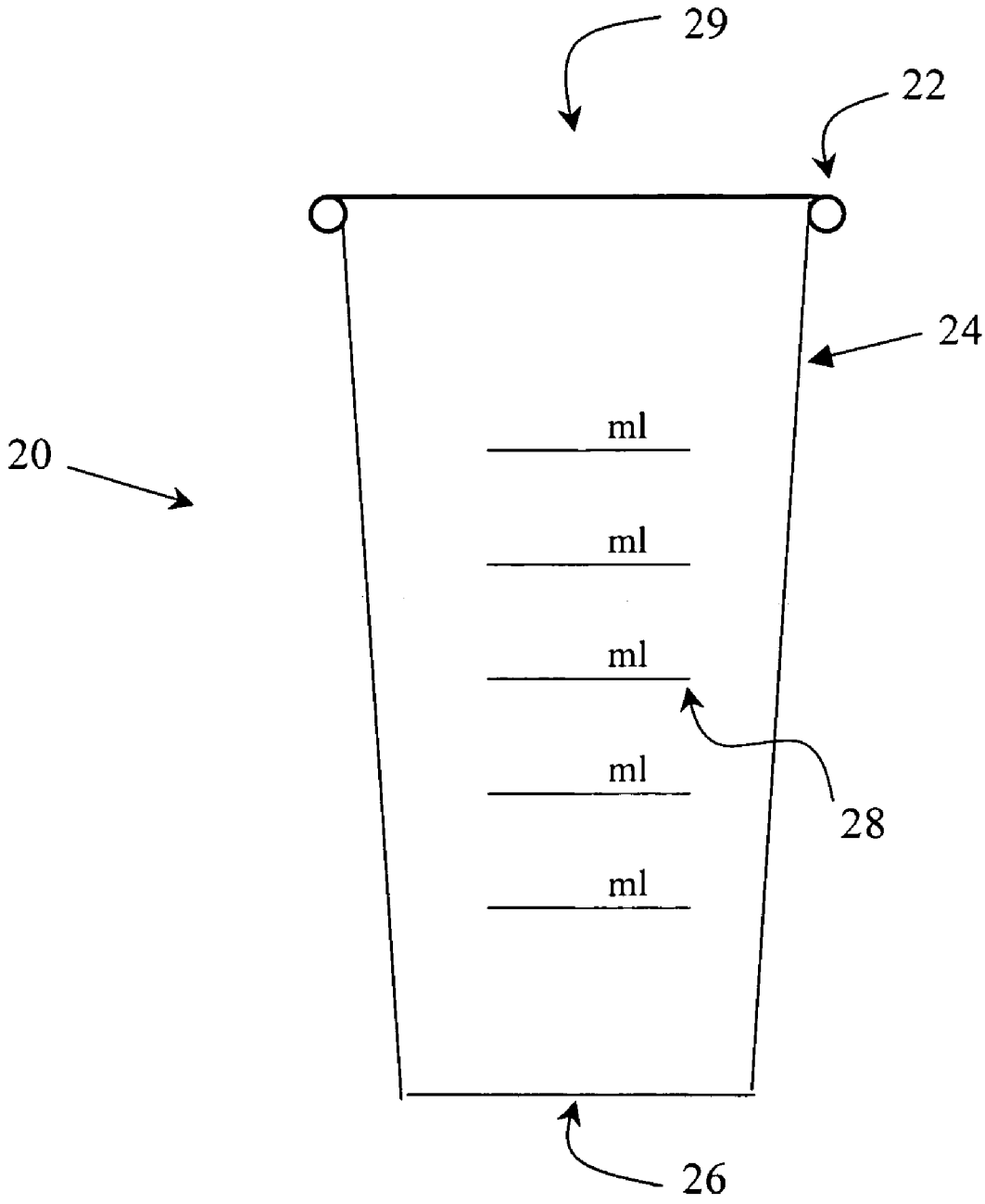
FIG. 2 representatively illustrates a plan view of the disposable container of FIG. 1.

The disposable container 20 shown in FIG. 2 of the preferred embodiment has a cylindrical shape, having a container body 24, an opening end 29, a closed end 26, a flange 22 and graduated markings 28. The container 20 has preferably larger opening end and smaller closed end to allow stacking of multiple containers 20 for packaging. The container 20 has preferably graduated markings printed on the outside and/or the inside of the container body 24.

Figure 4:
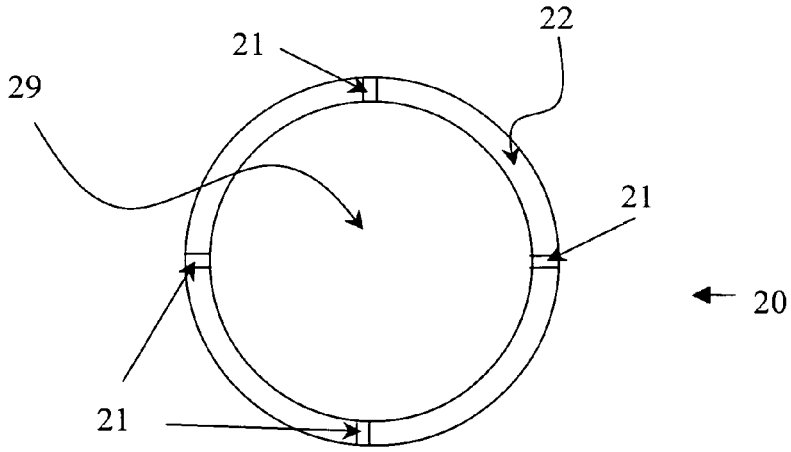
FIG. 4 representatively illustrates a top view of the disposable container of FIG. 2.
Figure 3C:
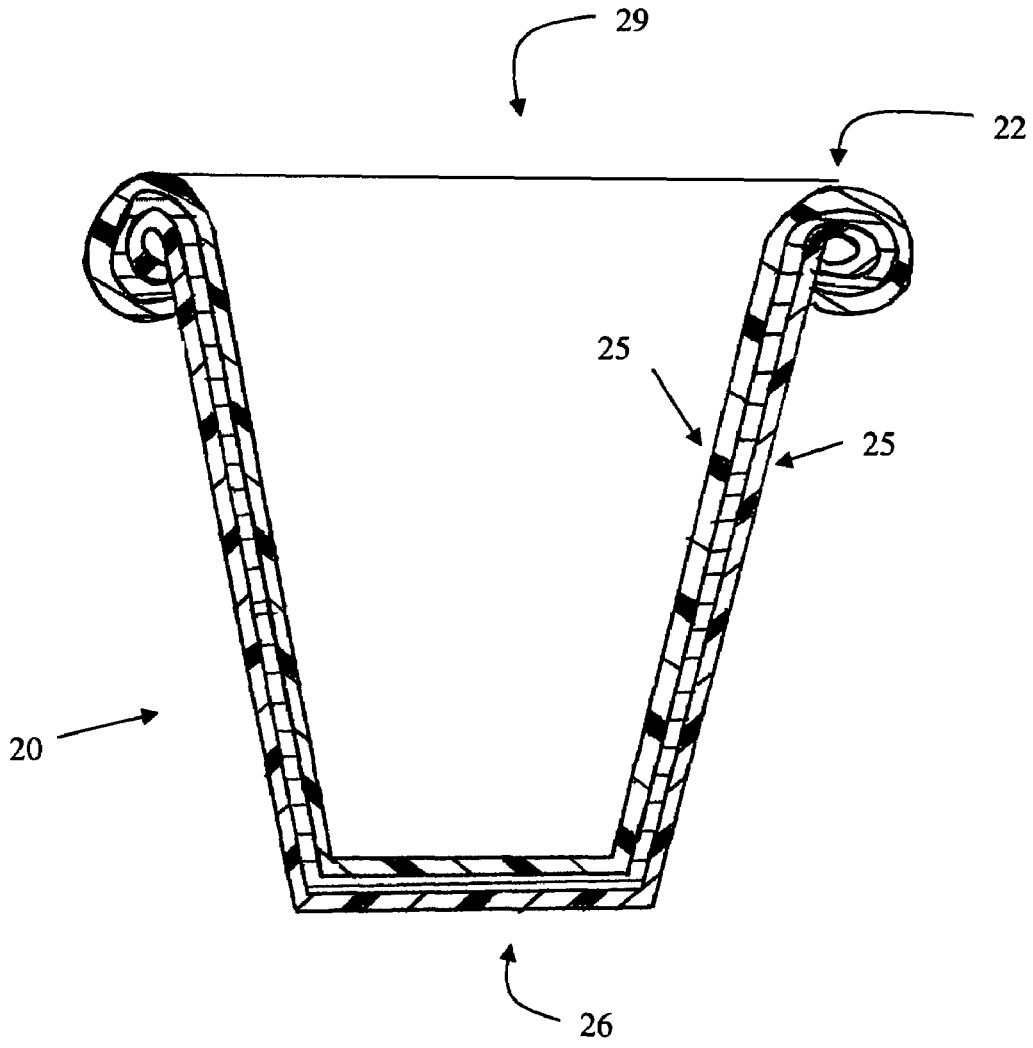
Figure 3D:
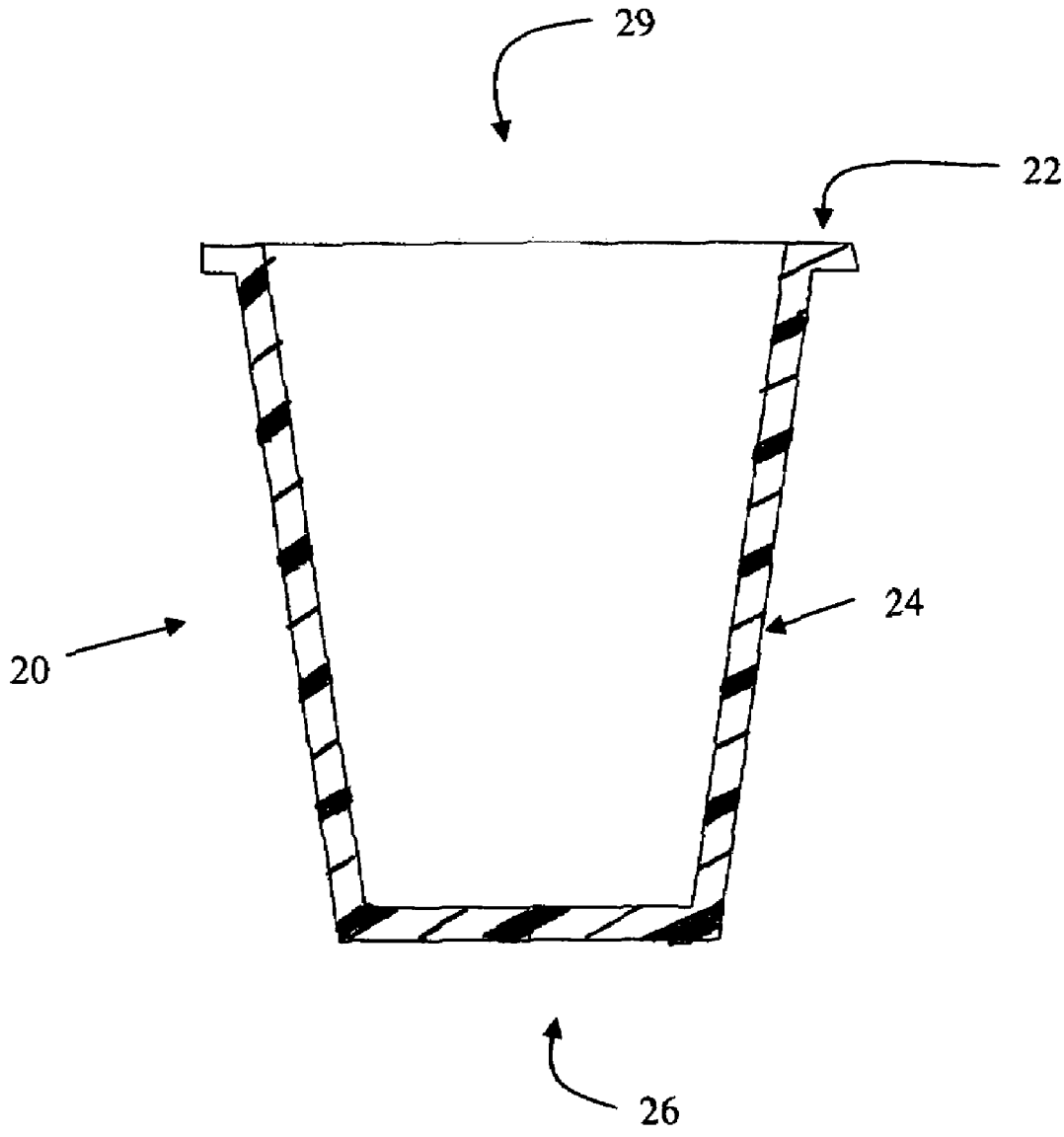

Referring to FIG. 4, the open end 29 of the disposable container is defined by the flange 22 which preferably circular in shape. The open end 29 is defined by the flange 22, which is extended outward from the container body 24 and along the entire circumference of the container body 24. The flange 22 preferably has grooves 21.

In the preferred embodiment, the flange 22, the container body 24 and the close end 26 are made from the same material. The flange 22, the container body 24 and the close end 26 need to be rigid enough that the container can support the weight of the liquid food therein and stand on its own without any support. Furthermore, the flange 22 is rigid enough that it can support the weight of the liquid food contain therein when the container is mounted on the holder 10.

The flange 22, the container body 24 and the close end 26 are made from a rigid material that is compression-resistant in the axial and/or radial direction. A container that comprises a compression-resistant material does not collapse or change substantially its shape or volume during normal feeding by the infant. A compression-resistant container can also withstand boiling water without deforming or distorting the shape of the container. Furthermore, it can withstand liquid food contained therein for three days in a refrigerator without weakening the container body 24 or resulting in liquid leakage. In addition, when placed in a water bath, a compression-resistant container preferably does not collapse, leak, or otherwise loose its rigidity and ability to be used. The container is preferably made from a water-proofed or water-resistant material. The preferable water proofed material is plastic or a polymer coated paperboard (i.e., comprised of a wood or cellulose material), which is coated on both side of the paperboard. The paperboard material can be any effective composition, including, e.g. selected kraft, bleached, news, or white-lined recycled or virgin paperboard. Polymers that can be used, include, e.g., polyethylene, polypropylene, polyester, polyethylene terephthalate, polybutylene terephthalate, derivatives thereof, etc. The thickness of the water-proofed or resistant material can be of any effective size, e.g., preferably from 0.1 to 1.0 mm. More preferably in a range of 0.2 to 0.7 mm. Even more preferably in a range of 0.3 to 0.5 mm. Other water-proofed or water-resistant material can be used as well, such as wax coated paperboard, polystyrene, foamboard, styrofoam, etc, and other laminate combinations.

Figure 3A:
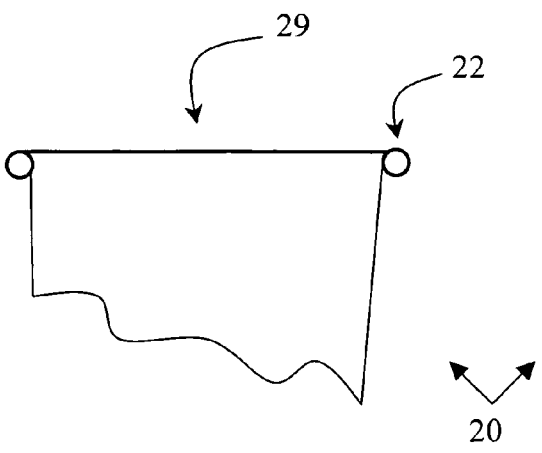
FIG. 3A & B reprehensively illustrate a cross section of the disposable container of FIG. 2.
Figure 3B:
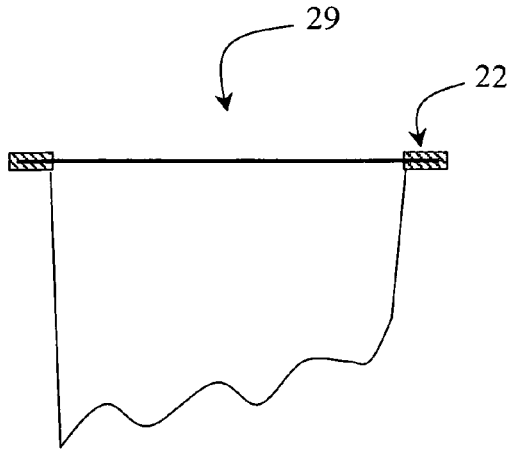
FIG. 3C & D representatively illustrate a cross section of an inventive container.

The flange 22 is formed by curling the material outward as shown in FIG. 3A. The curl significantly increases the rigidity of the flange 22, which will prevent the flange 22 from distorting from a circular shape when an excessive force is applied to the locking ring 40. FIG. 3B shows an alternative way to form the flange 22. In this approach, the flange 22 is formed by bonding the water proofed paperboard portion of the flange to a polymeric material for reinforcement. The suitable polymeric materials are, but not limited to, polypropylene, polyethylene, and polystyrene.

Figure 7:
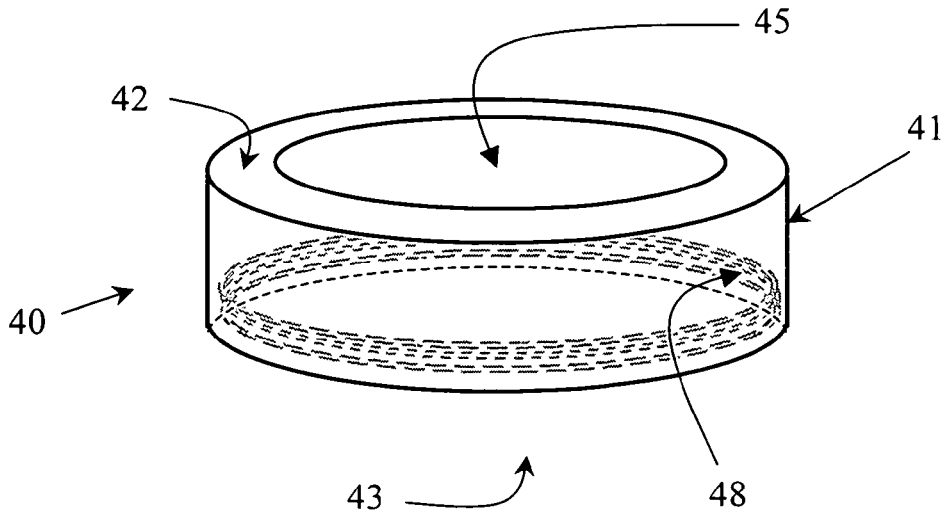
FIG. 7 representatively illustrates a locking ring.
Figure 8:
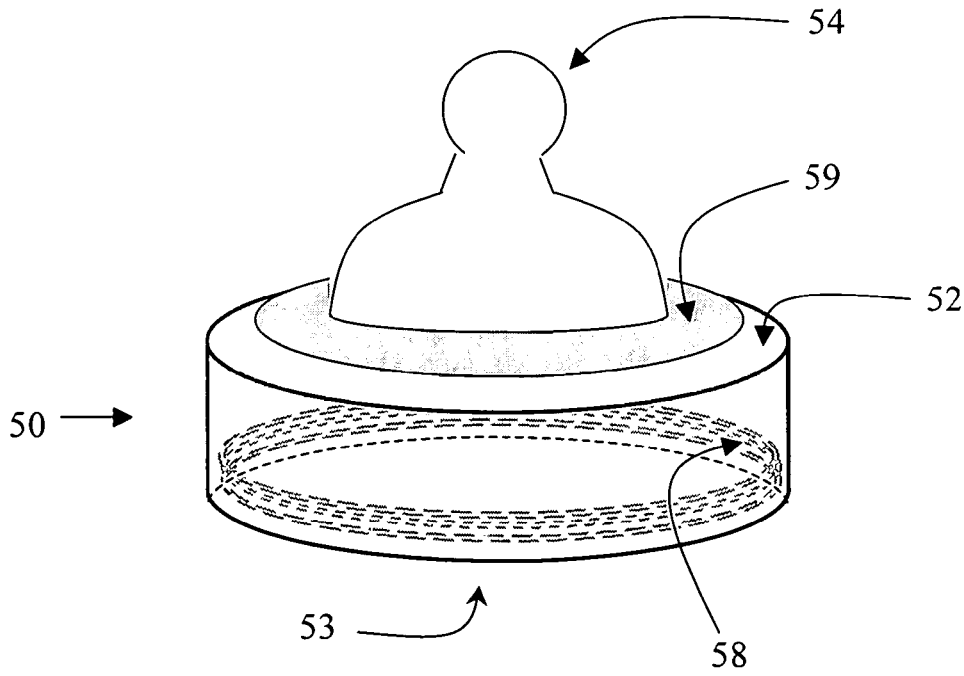
FIG. 8 representatively illustrates a one-piece nipple-ring assembly.

The locking ring 40 shown in FIG. 7 is used to attach the nipple 30 to the disposable container 20 and the holder 10. The locking ring 40 has a cylindrical shape, having a body 41, an opening end 43 and end wall 42 with a nipple opening 45 in it. The interior of the locking ring body 41 has inner threads 48.

The locking ring 40 is preferably made from rigid material such as polypropylene, polycarbonate and polystyrene.

Figure 5A:
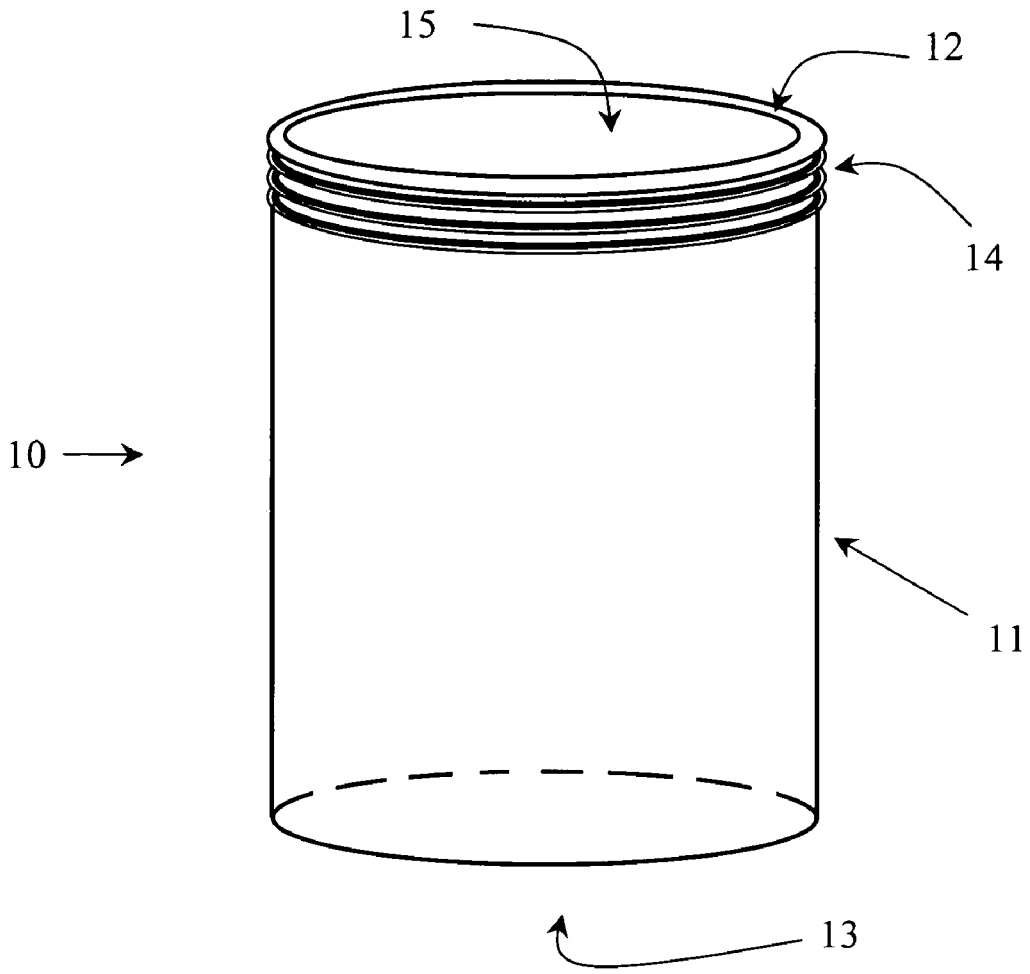
FIG. 5A-D representatively illustrate different holders that can be used with the disposable container of FIG. 1.

Referring to FIG. 5A, holder 10 has a cylindrical shape, having a holder body 11, a bottom open end 13, a top open end 15 and a rim 12. The top open end has external threads 14. The holder body 11 is preferably long enough to contain the entire disposable container body 24 therein. The rim 12 has an interior circumference that is large enough to receive the disposable container body 24. However, the interior circumference of the rim 12 should be smaller than the outer circumference of the flange 22, which allow the flange 22 to sit on top of the rim 12 when the disposable container 20 is inserted onto the holder 10.

The top open end 15 of the holder 10 is defined by the rim 12 which preferably circular in shape. The top open end 15 has external threads 14, which allow engagement of the top open end 15 with the locking ring 40.

Figure 5B:
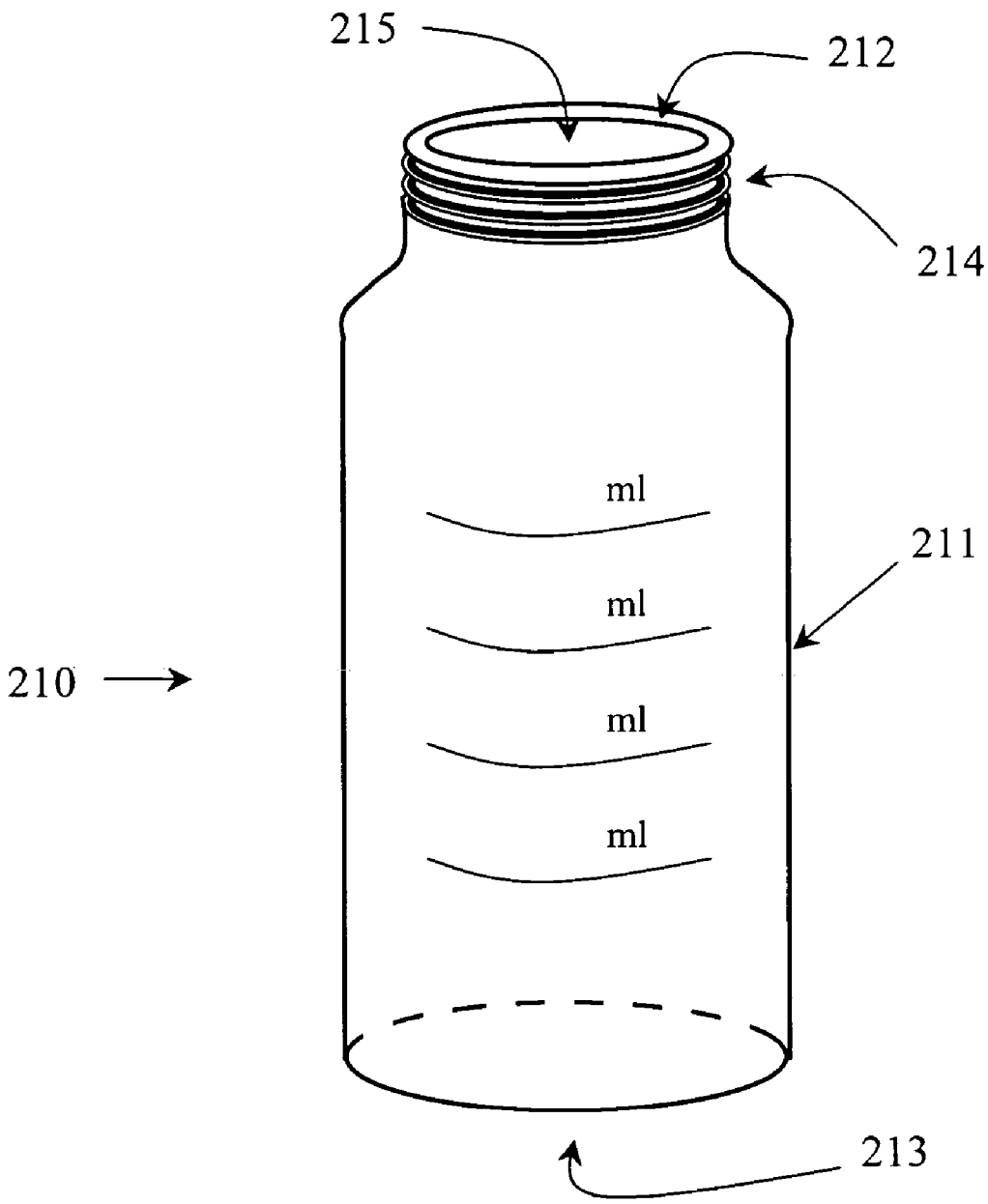

In an alternative embodiment, a reusable bottle 210 can be used as a holder (see FIG. 5B). The reusable bottle 210 has a cylindrical shape, having a body 211, a close end 213, an open end 215 and a rim 212. The open end has external threads 214. The reusable bottle body 211 should be long enough to contain the entire disposable container body 24 therein. The rim 212 has an interior circumference that is large enough to receive the disposable container body 24. However, the interior circumference of the rim 212 should be smaller than the outer circumference of the flange 22, which allow the flange 22 to sit on top of the rim 212 when the disposable container 20 is inserted onto the reusable bottle 210.

Figure 5C:
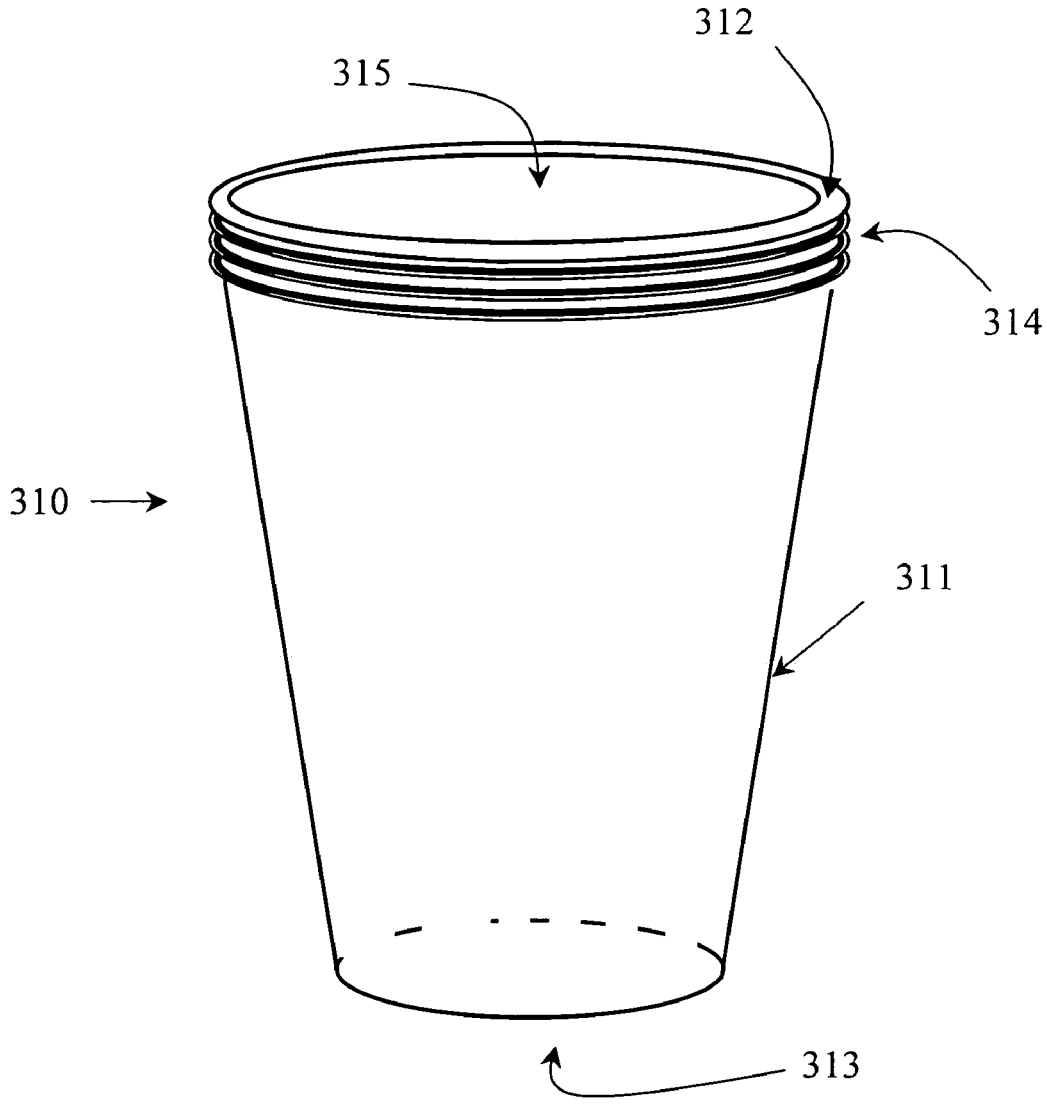
Figure 17:
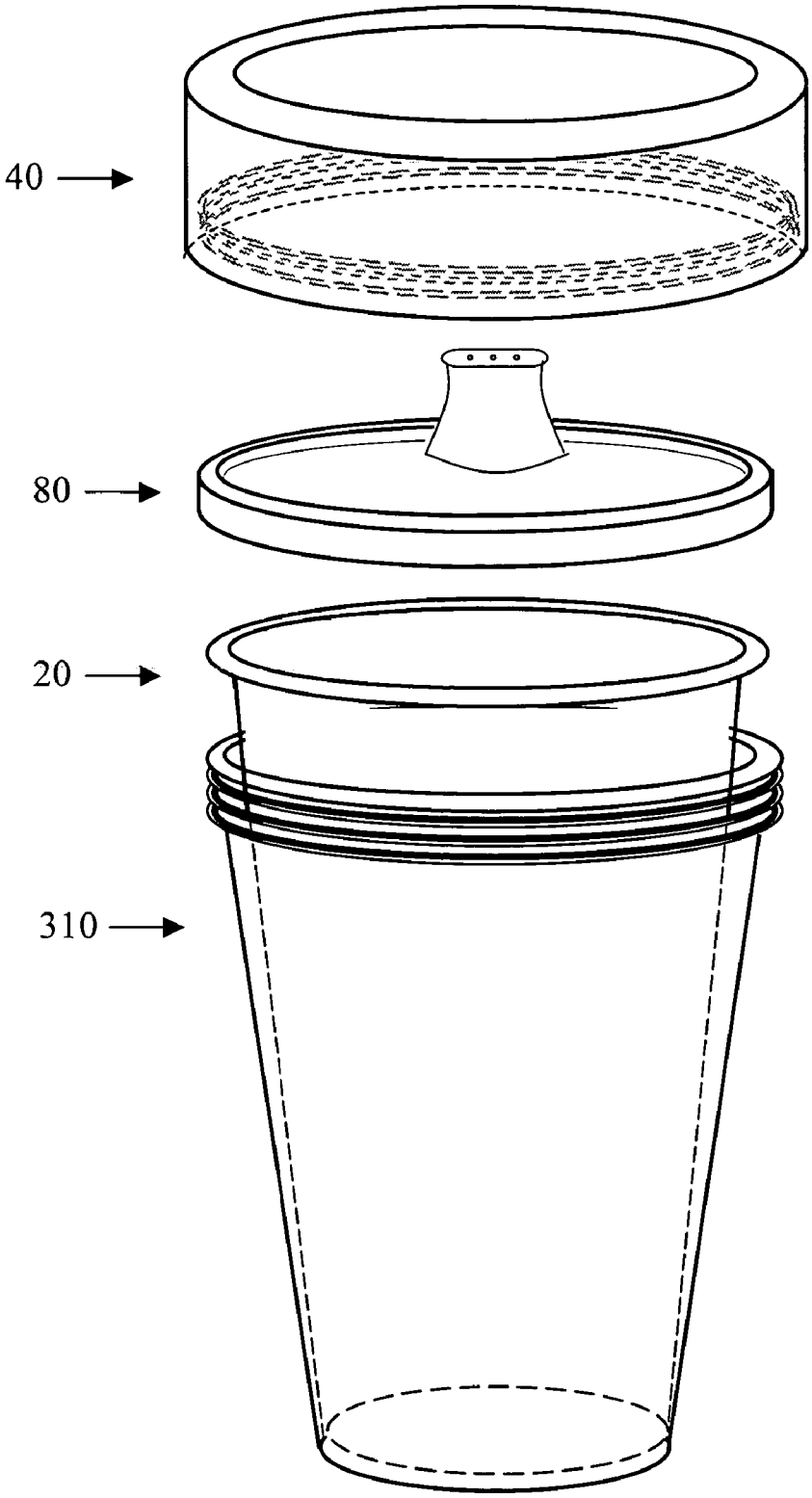
FIG. 17 representative illustrates an exploded view of an infant drinking cup according to the present invention, the infant drinking cup having a holder, a disposable container, a lid with drinking spout and a locking ring.
Figure 18:
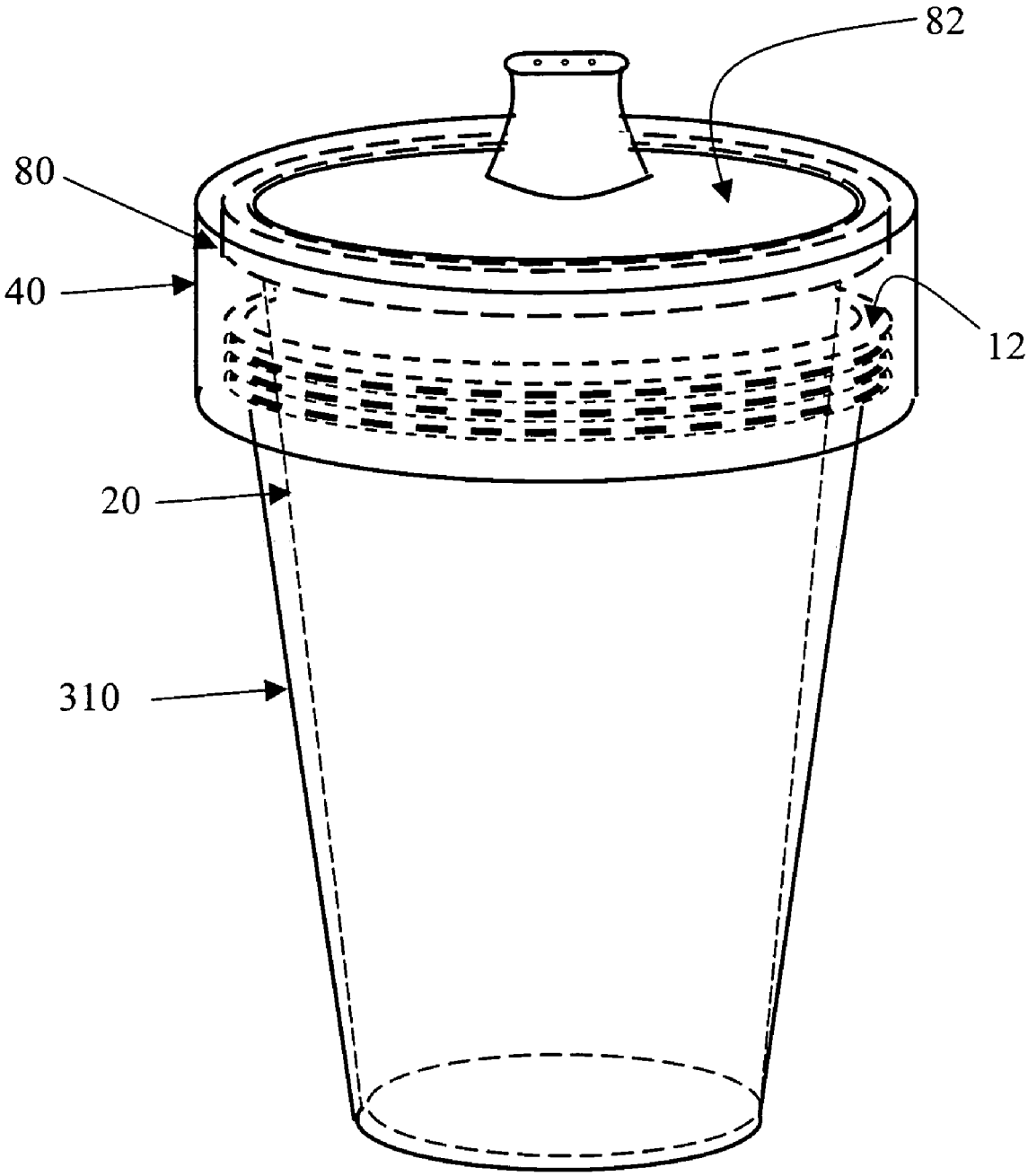
FIG. 18 representative illustrates an a perspective view of an infant drinking cup according to the present invention, the infant drinking cup having a holder, a disposable container, a lid with drinking spout and a locking ring.

In another alternative embodiment shown in FIG. 5C, holder 310 has a cylindrical shape, having a holder body 311, a bottom closed end 313, a top open end 315 and a rim 312. The top open end has external threads 314. Preferably, the holder 313 has larger opening end and smaller closed end to fit the disposable container body 24. The rim 312 has an interior circumference that is large enough to partially receive the disposable container body 24. In addition, the interior circumference of the closed end 313 is large enough to receive the disposable container closed end 26. However, the holder body 311 should be shorter than the disposable container body 24, which allow a gap between the flange 22 and the rim 312 when the disposable container 20 is inserted onto the holder 310 (See FIG. 17).

Figure 5D:
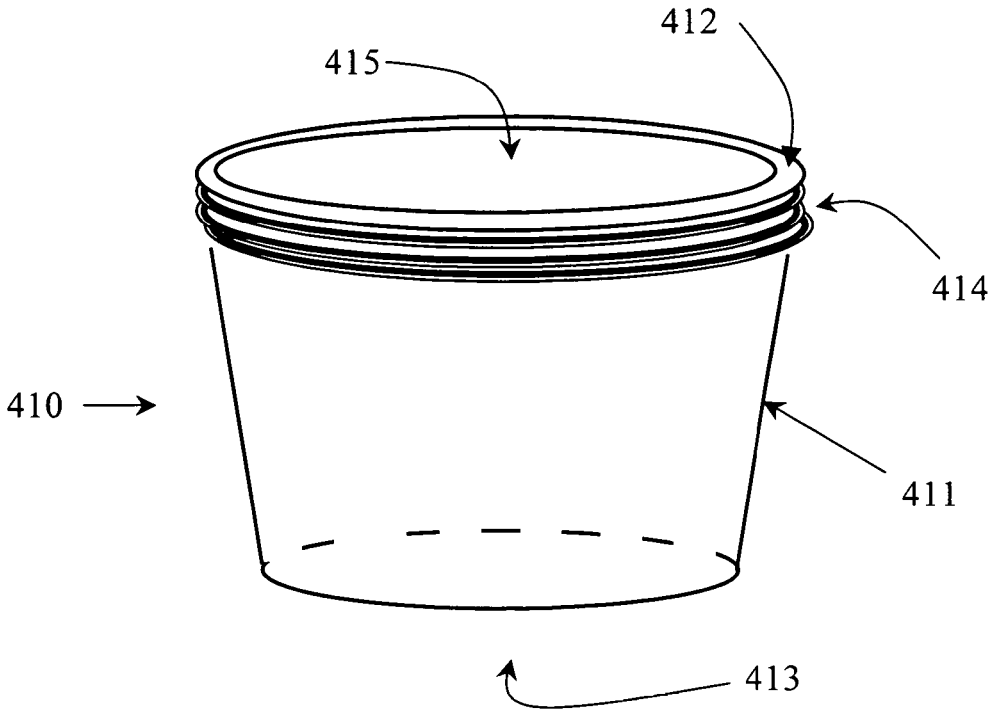
Figure 19:
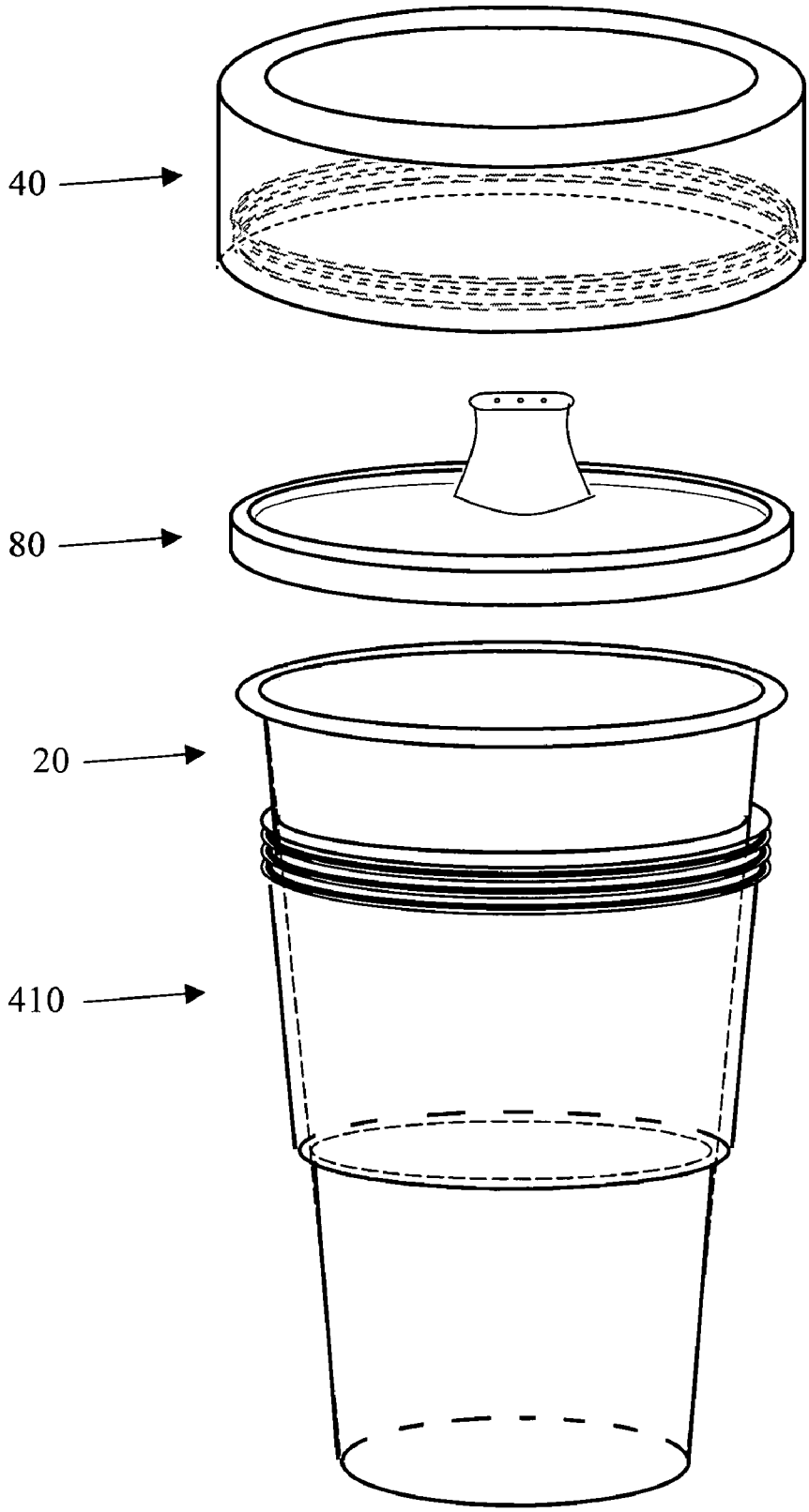
FIG. 19 representative illustrates an exploded view of an infant drinking cup according to the present invention, the infant drinking cup having a holder, a disposable container, a lid with drinking spout and a locking ring.
Figure 20:
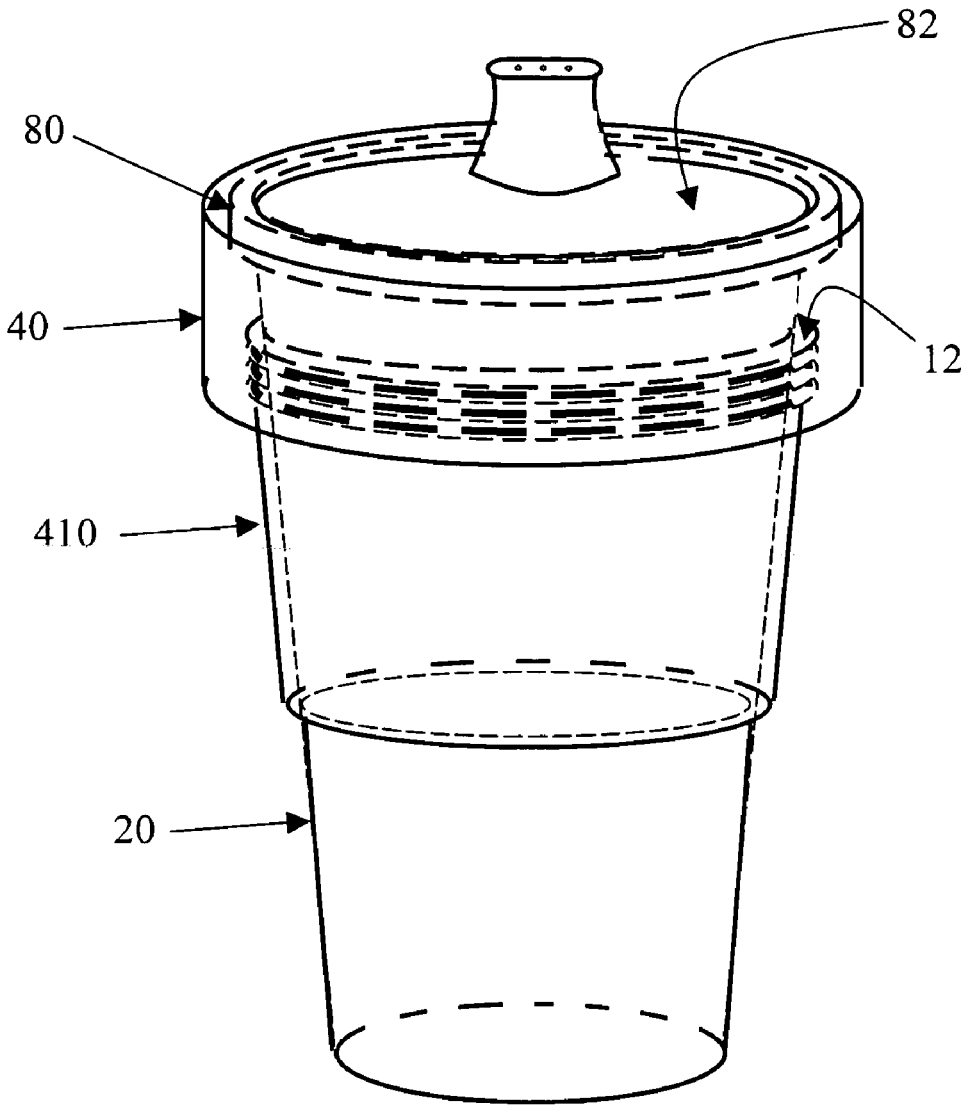
FIG. 20 representative illustrates an a perspective view of an infant drinking cup according to the present invention, the infant drinking cup having a holder, a disposable container, a lid with drinking spout and a locking ring.

In another alternative embodiment shown in FIG. 5D, holder 410 has a cylindrical shape, having a holder body 411, a bottom open end 413, a top open end 415 and a rim 412. The top open end has external threads 414. Preferably, the holder 413 has larger opening end and smaller closed end to fit into the disposable container body 24. The rim 412 and the open end 413 have interior circumferences that are large enough to partially receive the disposable container body 24 as shown in FIG. 19. The holder body 411 should be shorter than the disposable container body 24, which allow a gap between the flange 22 and the rim 412 when the disposable container 20 is inserted onto the holder 410 (See FIG. 19).

The holders 10, 210, 310 and 410 are preferably made from rigid material such as polypropylene and polycarbonate.

Figure 15:
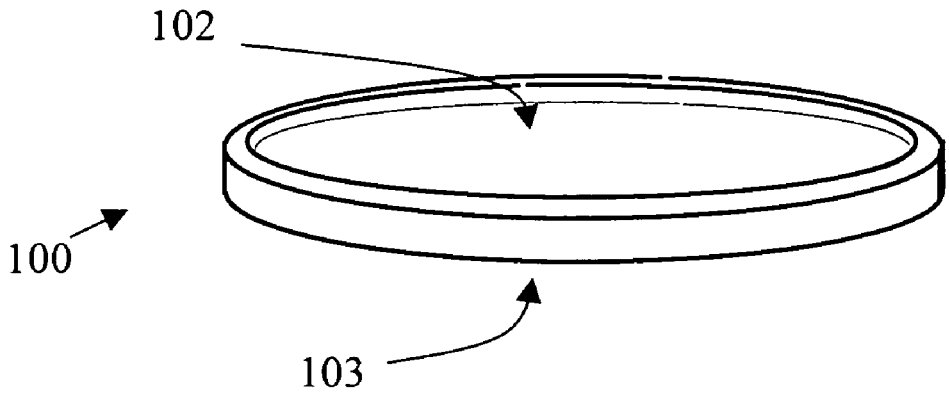
FIG. 15 representatively illustrates a lid.
Figure 16:
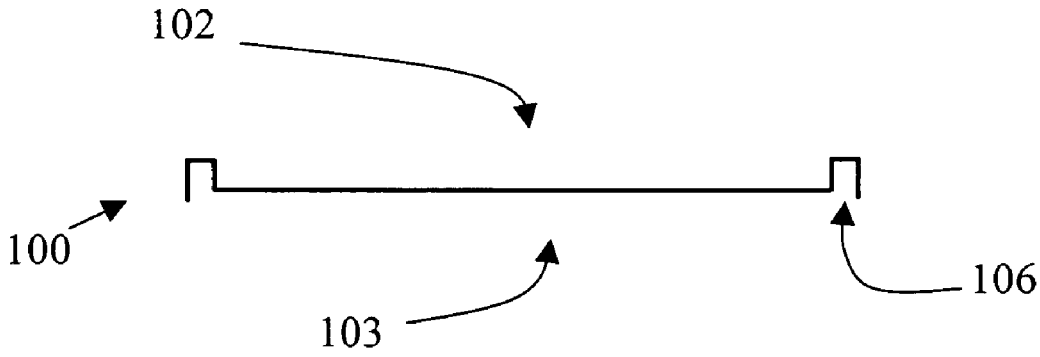
FIG. 16 representatively illustrates a cross section of the lid of FIG. 15.

The disposable lid 100 shown in FIG. 15 has a cylindrical shape, having an opening end 103 and close end 102. The opening end 103 has an interior circumference that is large enough to receive the flange 22. In the preferred embodiment, the body 34 should fit tightly around the flange 22 when the disposable lid 100 is engaged with the disposable container 20.

The disposable lid 100 is preferably made from polymer material such as polyethylene.

Figure 6:
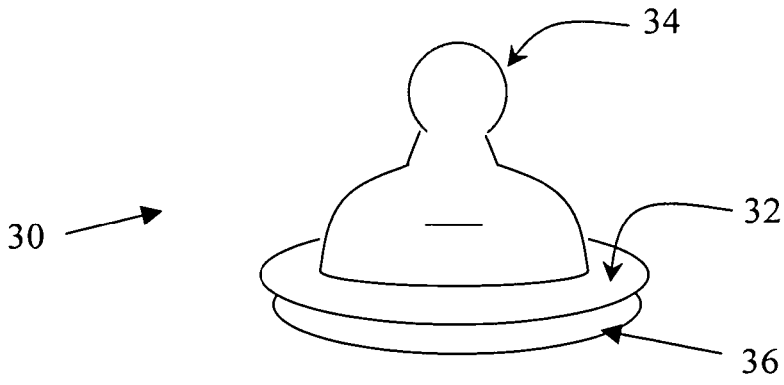
FIG. 6 representatively illustrates a conventional nipple.

Referring to FIG. 6, the nipple 30 has a flange 32, a mouthpiece 34 and an annular lip 36. The flange 32 is preferably circular in shape. The annular lip 36 is extended downward from undersurface of the flange 32 and along the entire circumference of the flange 32. The outer circumference of the flange 32 is slightly smaller than the inner circumference of the locking ring body 41 of the locking ring 40. The outer circumference of the annular lip 36 is slightly smaller than the inner circumference of the flange 22 of the disposable container 20.

The nipple 30 is preferably made from soft polymer material such as silicone.

Figure 9:
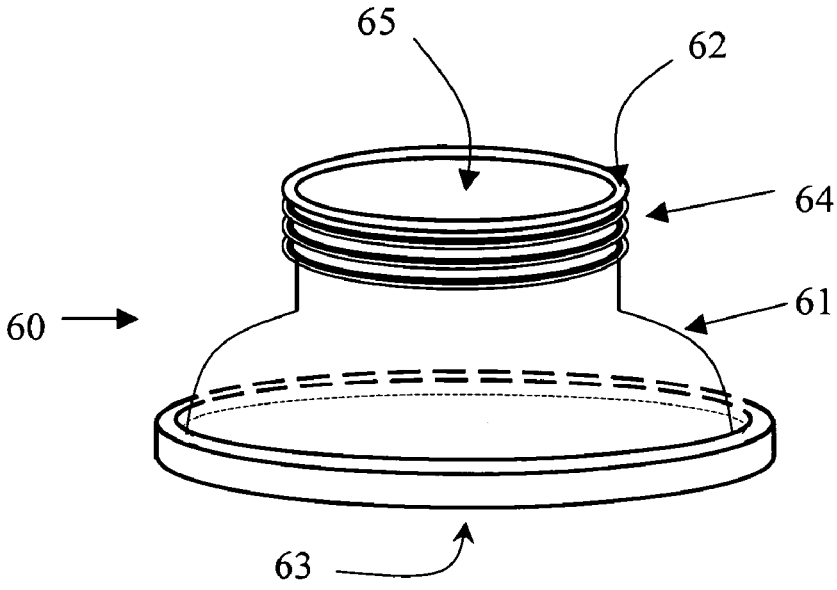
FIG. 9 representatively illustrates an adapter lid
Figure 10:
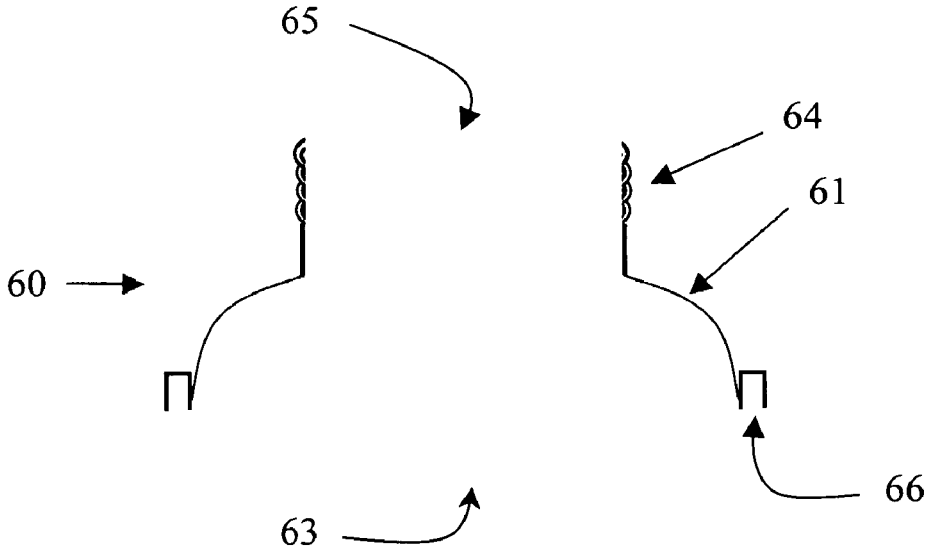
FIG. 10 representative illustrates a cross section of the adapter lid of FIG. 9.
Figure 11:
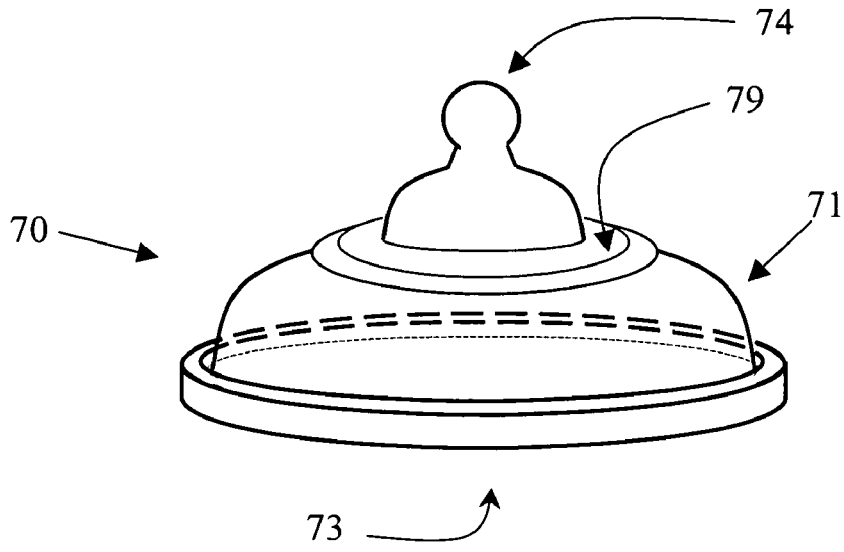
FIG. 11 representatively illustrates a one-piece nipple-lid assembly.
Figure 12:
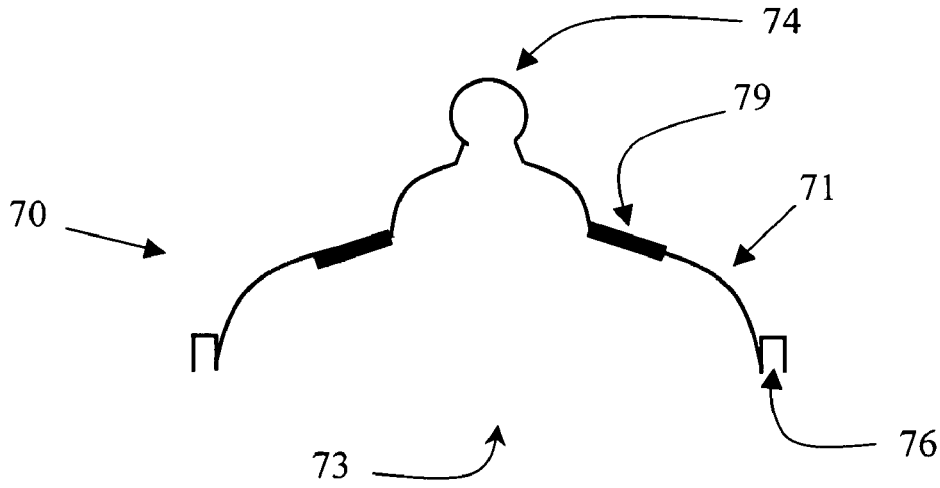
FIG. 12 representative illustrates a cross section of the nipple-lid assembly of FIG. 11.
Figure 13:
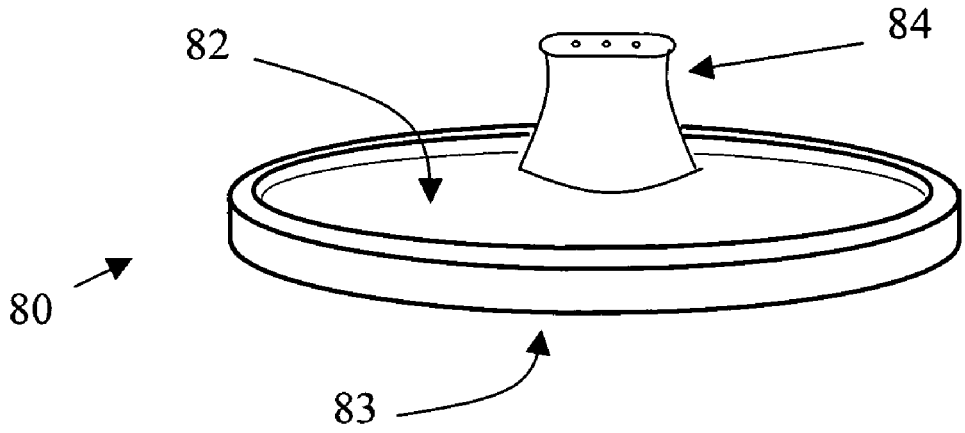
FIG. 13 representatively illustrates a lid with a drinking spout.
Figure 14:
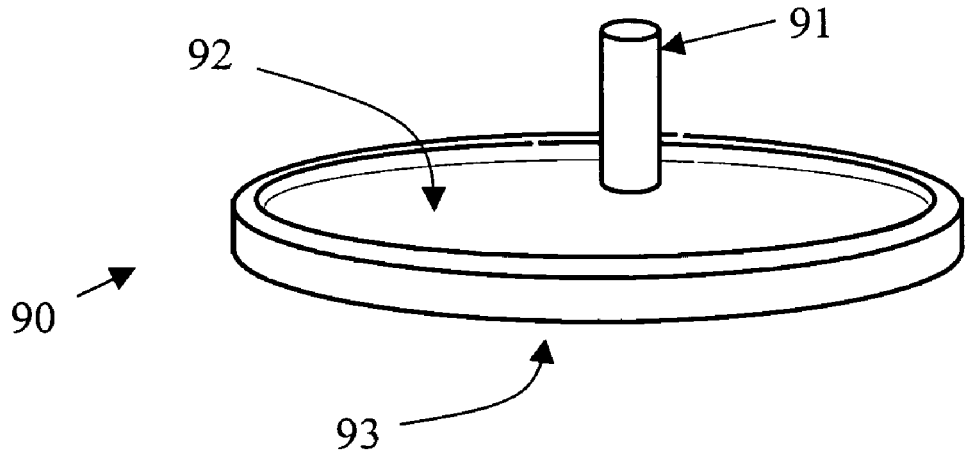
FIG. 14 representatively illustrates a lid with a drinking straw.
Figure 21:
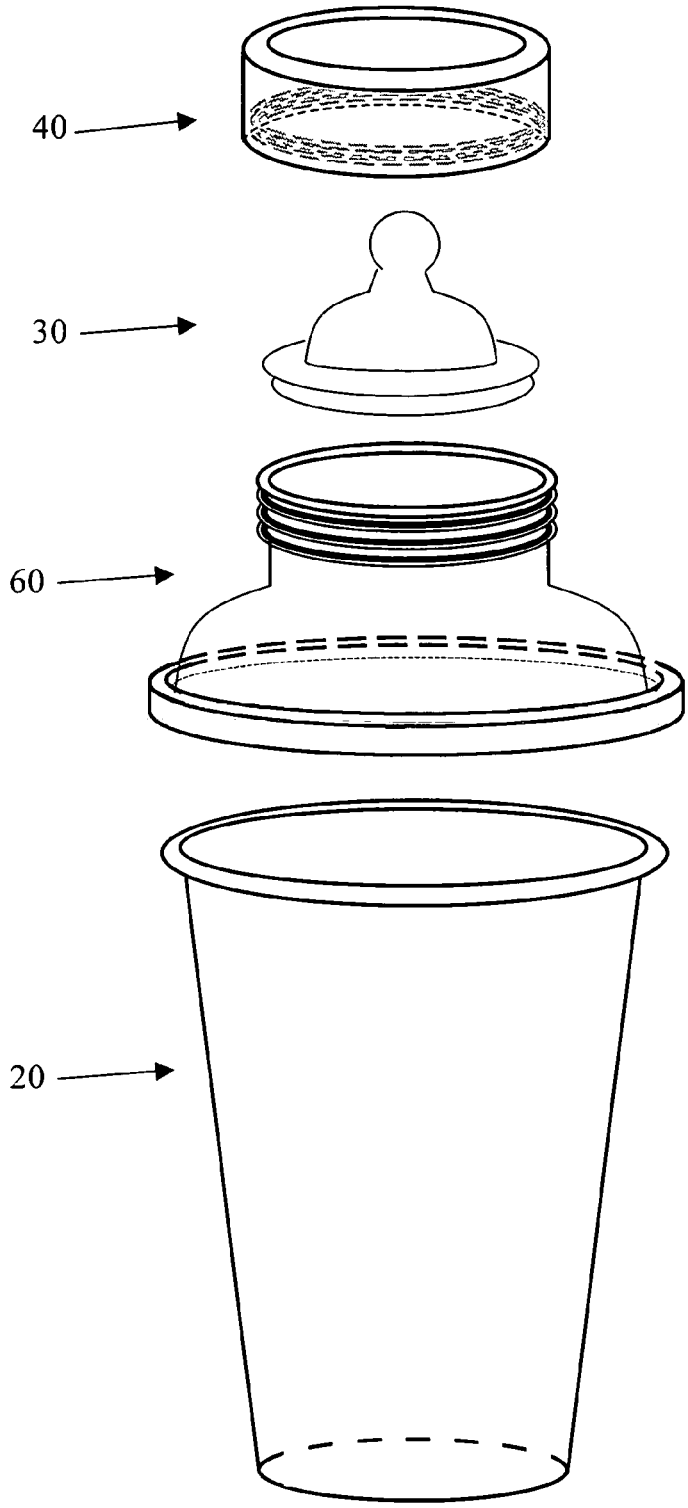
FIG. 21 representative illustrates an exploded view of an infant feeding assembly according to the present invention, the infant feeding assembly having a disposable container, a adapter lid, a nipple and a locking ring.
Figure 22:
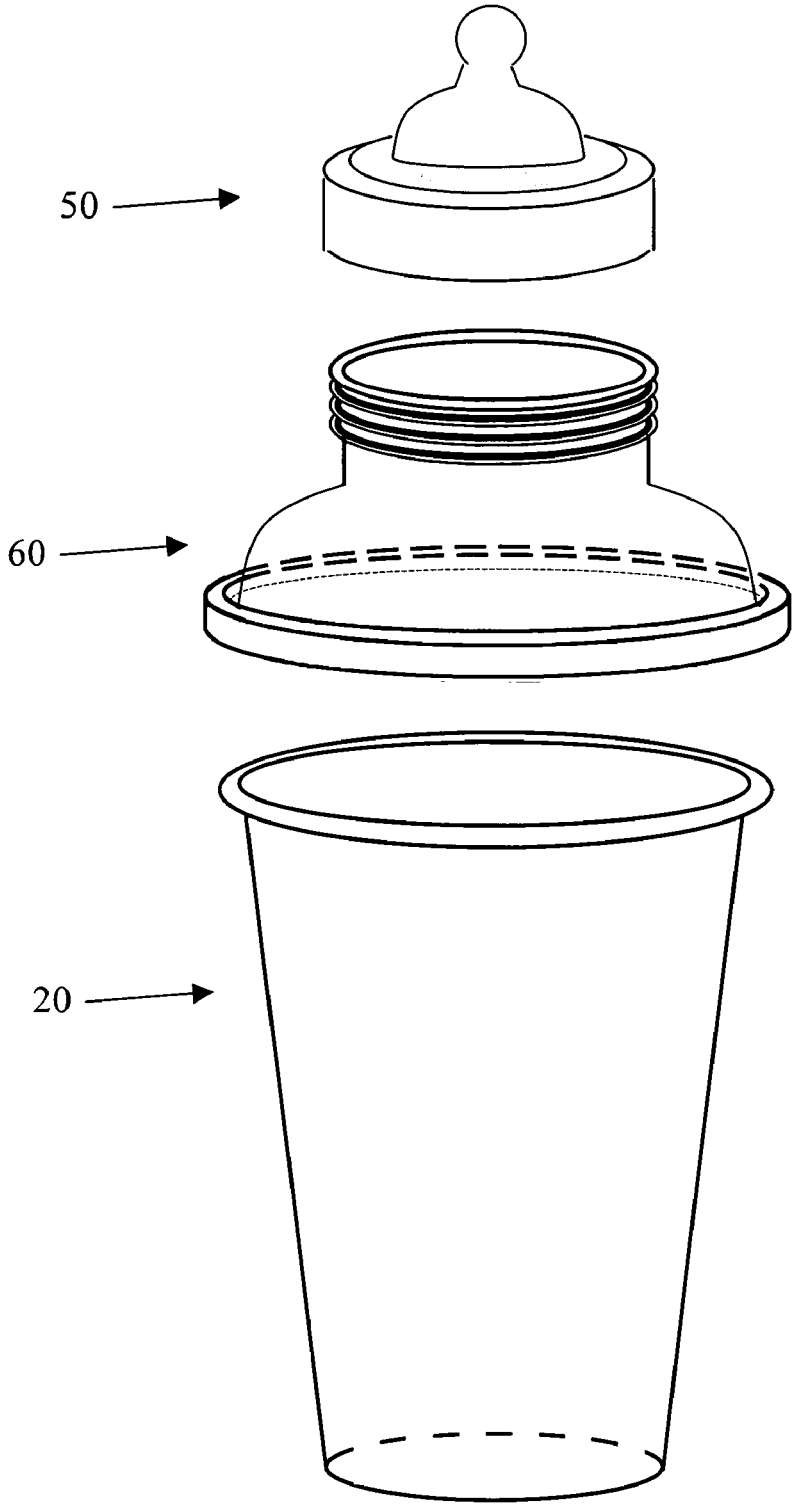
FIG. 22 representative illustrates an exploded view of an infant feeding assembly according to the present invention, the infant feeding assembly having a disposable container, an adapter lid, a nipple-ring assembly.
Figure 23:
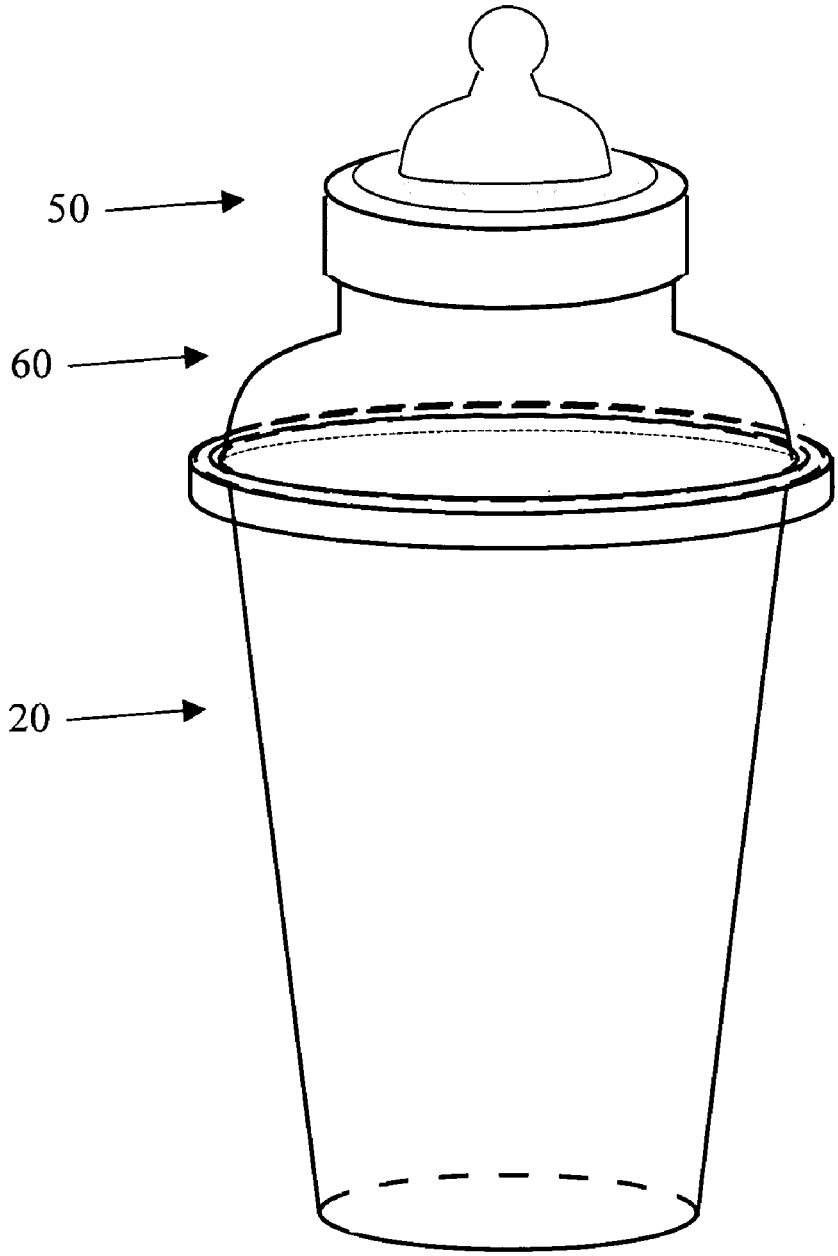
FIG. 23 representative illustrates an a perspective view of an infant feeding assembly according to the present invention, the infant feeding assembly having a disposable container, an adapter lid, a nipple-ring assembly.
Figure 24:
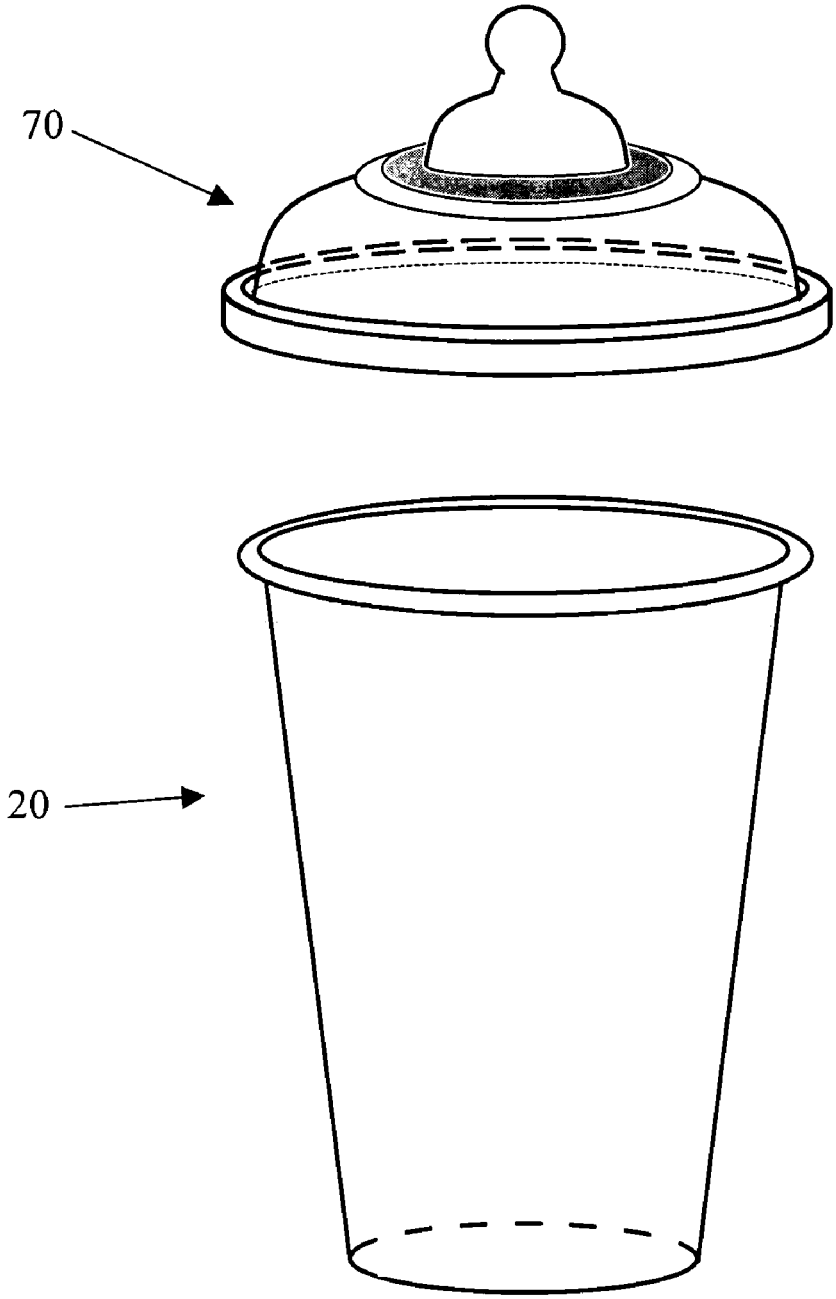
FIG. 24 representative illustrates an exploded view of an infant feeding assembly according to the present invention, the infant feeding assembly having a disposable container, a nipple-lid assembly.

Referring to FIG. 9, the adaptor lid 60 has a bottom open end 63, a top open end 65, a body 61, and a rim 62. The top open end has external threads 64. Preferably, the adaptor lid 60 has larger bottom open end 63 and smaller open top end 65. This allows the user to use a larger diameter disposable container with a smaller diameter locking ring (see FIG. 21). The adaptor lid 60 also has a locking recess channel 66, which can form a tight seal when it is engaged onto the flange 22 of the disposable container 20.

The user can use the nursing assembly of the present invention as follows

Step 1: for preparing infant formula, the user places a powder infant formula directly into the disposable container 20. Boiling water is then added to the disposable container 20. The infant formula/water mixture is stirred thoroughly and allowed to cool down to an appropriate temperature for feeding. The mixture can be cooled down by placing the disposable container 20 inside a water bath.

Step 2: the user can prepare infant formula and use it at a later time such as making infant formula early in the evening and use it for late night feedings. In this case, the user can prepare infant formula in the disposable container 20 as described in step 1. The disposable lid 100 is then used to seal the open end 29 of the disposable container 20 before the disposable container 20 is placed in the refrigerator for storage.

Step 3: for traveling, the user can prepare infant formula in the disposable container 20 as describe step 1 in advance. The filled disposable container 20 maybe packed in a diaper bag for traveling. In this case to prevent leakage, the user engages the disposable lid 100 onto the flange 22 of the disposable container 20. The user then inserts the filled disposable container 20 into the holder 310. The locking ring 40 is then engaged into the holder 310. The inner threads 48 of the locking ring 40 are then engaged with the external threads 14 of the holder 310. When the locking ring 40 is tightly engaged with the holder 310, the disposable lid 100 is pressed tightly against the flange 22 of the disposable container 20. This prevents the infant formula contain therein from leaking. The engaged nursing assembly can be packed in a diaper bag for traveling.

Step 4: feeding at home, the stored infant formula described in step 2 can be use for feeding. The disposable container 20 is first removed from the refrigerator. The disposable cover 30 is then removed from the disposable container 20 and discarded. The user inserts the filled disposable container 20 into the holder 10, which causes the flange 22 to sit on top of the rim 12 of the holder 310. The user then engages the nipple 30 with the locking ring 40 so that the flange 32 of the nipple 30 is against the interior of the end wall 42 of the locking ring 40. The inner threads 48 of the locking ring 40 are then engaged with the external threads 14 of the holder 310. When the locking ring 40 is tightly engaged with the holder 310, the flange 32 of the nipple 30 is pressed tightly against the flange 22 of the disposable container 20. This prevents the infant formula contain therein from leaking. After feeding, the locking ring 40 is disengaged from the holder 310 so that the empty disposable container 20 can be removed and discarded.

Step 5: feeding while traveling, the stored infant formula described in step 3 can be use for feeding. The locking ring 40 is first disengaged from the holder 310 so that the disposable lid 100 can be removed. The user then engages the nipple 30 with the locking ring 40 so that the flange 32 of the nipple 30 is against the interior of the end wall 42 of the locking ring 40. The inner threads 48 of the locking ring 40 are then engaged with the external threads 14 of the holder 310. When the locking ring 40 is tightly engaged with the holder 310, the flange 32 of the nipple 30 is pressed tightly against the flange 22 of the disposable container 20. This prevents the infant formula contain therein from leaking. After feeding, the locking ring 40 is disengaged from the holder 310 so that the empty disposable container 20 can be removed and discarded The nursing assembly provided by the present invention provides convenience, versatility and hygienic.

As various changes could be made in the above disposable container 20 without departing from the scope of the invention, it is intended that all matter contained in the above description and shown in the accompanying drawings shall be interpreted as illustrative and not in a limiting sense.

What is claimed is:

1. An infant feeding container assembly, comprising (a) a holder having a cylindrical shape, an open end, and a closed end, wherein said open end is for receiving a disposable, compression-resistant container, and said open end is capable of receiving said disposable, compression-resistant container engaging a feeding nipple; and (b) a disposable, compression-resistant, cylindrical container for inserting engageably into the open end of said holder, the container comprising paper-board and having an open upper end and a closed lower end and a flange defining the open upper end, the flange engaging both the feeding nipple and the holder; and (c) a locking ring, said holder comprising a threaded open end for receiving the locking ring.

2. An infant feeding container assembly of claim 1, wherein said container comprises a polymer coated paper-board.

3. An infant feeding container assembly of claim 2, wherein said container comprises a polyethylene, polypropylene, or polyester coated paper-board which is coated on both side of the paper-board.

4. An infant feeding container assembly of claim 1, wherein said container comprises a water proofed material.

5. An infant feeding container assembly of claim 1, wherein the holder comprises a rim at its open end, and said flange rests on said rim when the container is inserted into said holder.

6. An infant feeding container assembly of claim 1, wherein said flange is bonded to a polymeric material.

7. An infant feeding container assembly of claim 1, wherein the nipple is of one-piece construction.

8. A toddler training cup assembly, comprising (a) a holder having a cylindrical shape, an open holder end, and a closed holder end, wherein said open holder end is for receiving a disposable, compression-resistant container, (b) a disposable, compression-resistant, cylindrical container for inserting engageably into the open holder end, wherein said container has an open container end and a closed container end, and has a flange at the open container end for tightly and sealably engaging a disposable a lid with a drinking spout.

9. A toddler training cup assembly of claim 8, wherein said container comprises water-proof or water-resistant material.

10. A toddler training cup assembly of claim 8, wherein said material is a polymer coated paper-board or plastic.

11. A toddler training cup assembly of claim 8, wherein said holder comprises a threaded open holder end for receiving a locking ring.

12. A toddler training cup assembly of claim 8, wherein said holder comprises a rim at its open end, and there is a space between said flange and said rim to accommodate said lid when the container is inserted into said holder.

13. A toddler training cup assembly of claim 12, wherein said holder comprises a larger open holder end than the closed holder end, and wherein said container has a larger inner diameter at its open end than open holder end to keep said container from falling through said holder.

14. An infant feeding container assembly, comprising (a) a holder having a cylindrical shape, an open end, and a closed end, wherein said open end is for receiving a disposable, compression-resistant container, and said open end is capable of receiving said disposable, compression-resistant container engaging a mouth piece; and (b) a disposable, compression-resistant, cylindrical container for inserting engageably into the open end of said holder, the container comprising paper-board and having an open upper end and a closed lower end; and (c) a locking ring, said holder comprising a threaded open end for receiving the locking ring.

* * * * *